US005257566A

United States Patent [19]

Schultz

[11] Patent Number: 5,257,566

[45] Date of Patent: Nov. 2, 1993

[54] THUMB FITTING, RING-LIKE, FLIP-TOP CAN OPENING APPARATUS AND METHOD OF USING

[76] Inventor: Edward F. Schultz, P.O. Box 1093, Tombstone, Ariz. 85638

[21] Appl. No.: 986,377

[22] Filed: Dec. 7, 1992

[51] Int. Cl.[5] ..... B67B 7/40

[52] U.S. Cl. ..... 81/3.55; 81/3.09; 7/151; D8/18

[58] Field of Search ..... 81/3.07, 3.09, 3.4, 81/3.55, 3.57; 7/151; D8/33, 34, 40, 18, 38

[56] References Cited

U.S. PATENT DOCUMENTS

| | | | |
|---|---|---|---|
| D. 291,050 | 7/1987 | McIntire | D8/18 |
| 3,495,284 | 2/1970 | Weingardt | 81/3.55 |
| 4,667,544 | 5/1987 | Milo | 81/3.55 |
| 4,765,208 | 8/1988 | Sakosky | 81/3.55 |
| 5,029,495 | 7/1991 | Rosenberger | 81/3.09 |

*Primary Examiner*—Roscoe V. Parker
*Attorney, Agent, or Firm*—Victor Flores

[57] ABSTRACT

An opener accessory for opening containers designed with flip-top opening mechanisms. The accessory is formed in the shape of a finger band having a pry end extending from the finger band for urging a pull-tab member of a flip-top opening mechanism. The opener accessory is preferably produced from a flat, thin, narrow, one-piece construction metallic structure formed having a pry end at one end and a finger band end at the other end. The finger band is formed as a rounded portion and a straight portion for encircling a user's finger, such as a thumb. The straight portion extends across the rounded portion and terminates at the finger band end. The pry end is formed as an integral extension of the finger band's rounded portion and is preferably machined stamped and chamfered for facilitating snagging a pull-tab member of the flip-top opening mechanism. In certain respects the accessory's pry end resembles a fingertip and fingernail, but accomplishes the same function without the normal prying discomfort.

12 Claims, 1 Drawing Sheet

THUMB FITTING, RING-LIKE, FLIP-TOP CAN OPENING APPARATUS AND METHOD OF USING

FIELD OF THE INVENTION

The present invention relates to container opening apparatus. More particularly, the present invention relates to accessories that aid in opening containers that have a flip-top opening system.

BACKGROUND OF THE INVENTION

The prior art teaches that sealed beverage containers and certain canned food containers are provided with flip-top opening mechanism as a means of accessing the contents. The flip-top opening mechanism relies on the use of a consumer's fingertip and/or fingernail for applying the upward urging force at the pull-tab which initiates the opening process. While much has been done to make the flip-top can opening task somewhat user-friendly, there is still room for improvement. For example, pull-tabs have been designed with more circumfirential mass to minimize the amount of flatness contact with the underlying container lid structure. However, a limitation exist as to how much of the tab's pull region can be allowed to remain lifted to effect a user-friendly finger contact, and yet not present a problem for inadvertent contact opening. Needless to say, the inadvertent contact opening concern prevails to the demise of broken fingernails, and to flip-top containers having their pull tabs deposed very close to the underlying lid surface area and any depressed region provided. The fingernail damaging problem is greatly amplified among persons that serve beverages from flip-top beverage containers, such as flight attendants, bartenders, and the like.

A prior art accessory known for opening flip-top cans, concerns a short strip plastic structure having a recess at one end. The recess is used for inserting the pull-tab and for applying the required upward force to open the container. While the apparatus saves the fingernails, it must be placed in a convenient place after use to free up the hand to give change to a buyer for a beverage purchase, or if a long period lapses before another container must be opened. This type of accessory opener is not suitable for a multiple beverage server because of the awkwardness associated with having to free up the hand to give change and then search around for the opener.

Thus, a need is seen to exist for a flip-top container opening accessory which aids in opening a container having a flip-top opening system.

A need is further seen to exist for a flip-top container opening accessory which not only aids in opening a container having a flip-top opening system, but that also remains inconspicuously on the user, ready for another flip-top opening task, while freeing up the user's hand to do other tasks.

SUMMARY OF THE INVENTION

Accordingly, the primary object of the present invention is to provide an accessory which aids in opening a container having a flip-top opening system.

Another object of the present invention is to provide an accessory which not only aids in opening a container having a flip-top opening system, but that also remains inconspicuously on the user, ready for another flip-top opening task, while freeing up the user's hand to do other tasks.

The foregoing objects are accomplished by providing an accessory apparatus for opening containers designed with flip-top opening mechanisms, the apparatus comprises a finger band means for carrying the apparatus and a pry means that extends away from the finger band means for upwardly urging the flip-top opening mechanism. The finger band means and the pry means being preferably produced from a flat, thin, narrow, one-piece construction metallic structure formed having a pry end at one end and a finger band end at the other end. As stated above, the finger band means comprises a rounded portion and a straight portion for encircling a user's finger, such as a thumb, the straight portion extends across the rounded portion and terminates at the finger band end. The pry means is preferably an integral extension of the rounded portion and terminates at a chamfered pry end. The pry end is preferably machined stamped and chamfered for facilitating snagging a pull-tab member of the flip-top opening mechanism, resembling a fingertip, including a fingernail.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT

Figure 2:
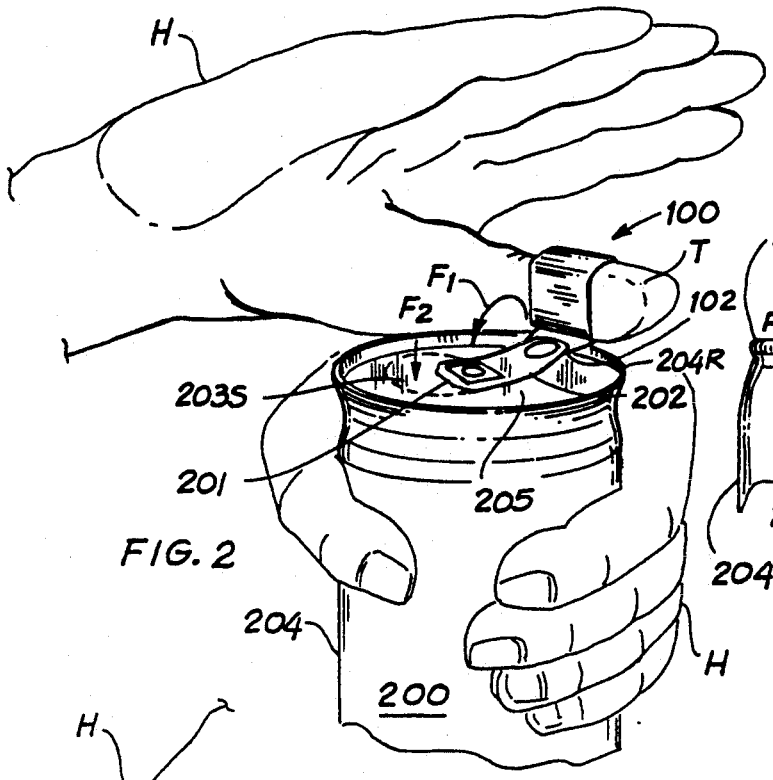
FIG. 2 is a perspective view of the present invention fitted on a thumb and being used to urge a pull-tab member of a flip-top opening mechanism provided on a container.
Figure 2A:
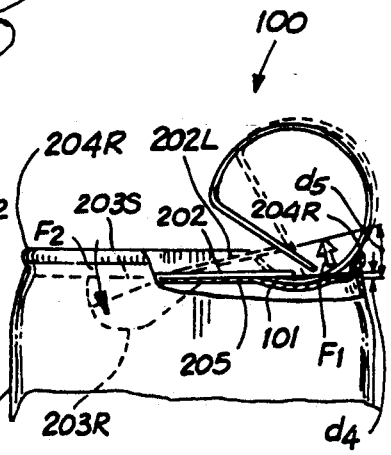
FIG. 2*a* is a partial sectional side view of the present invention illustrated in FIG. 2 further showing the pry end portion of the opener accessory positioned beneath the pull-tab member of the flip-top opening mechanism for acting on a break-away seal member of the container.
Figure 3:
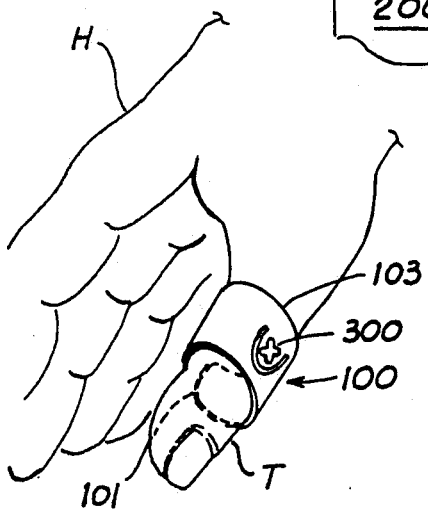
FIG. 3 is a perspective view of the present invention fitted on a thumb illustrating a decorative item on the upper portion of the finger band means shown, by example, in the form of a mark means for indicating correct orientation of the pry end of the accessory.
Figure 1:
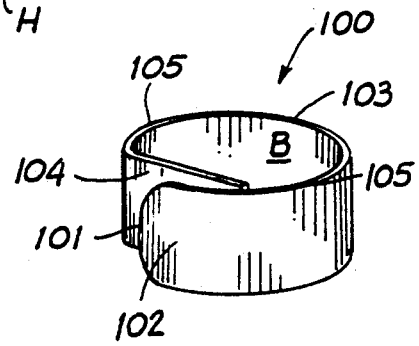
FIG. 1 is a perspective view of the present invention illustrating the split, ring-like shaped finger band means and the pry means used for urging a pull-tab member of a flip-top opening mechanism provided on sealed containers.
Figure 4:
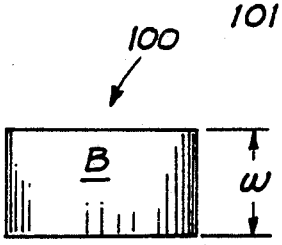
FIG. 4 is a top view of the present invention illustrating the band shape of the invention.
Figure 6:
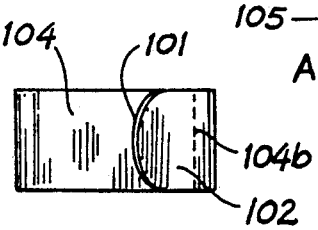
FIG. 6 is a bottom view of the present invention taken along line 6—6 in FIG. 5 illustrating another view of the pry end of the accessory.
Figure 5:
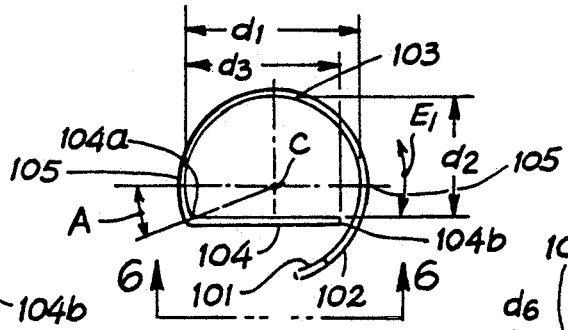
FIG. 5 is a side view of the present invention illustrating the finger band means for carrying the accessory and the pry means extending from the finger band means for urging the pull-tab member of the flip-top opening mechanism.
Figure 5A:
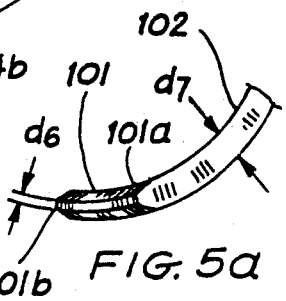
FIG. 5*a* is an enlarged view of the pry end of the accessory illustrating the chamfered end of the pry end for facilitating snagging a pull-tab member of the pull tab member of the flip-top opening mechanism.

FIG. 1 shows the present invention in the form of an opener accessory 100 for use in opening containers, such as container 200 illustrated in FIG. 2, provided with flip-top opening mechanisms. Opener accessory 100 is provided in the form of a split, ring-like shaped finger band means B including an upper band portion 103, a straight portion 104, a diameter delineated by points 105, and a pry means 102 terminating at a pry end 101. As illustrated in FIG. 2, accessory 100 is preferably worn by a user on the thumb T, but may be sized and adapted for use on any finger of a user's hands H. The dimensions d1 and d2 shown in FIG. 5 are the primary dimensions for determining the size of the accessory to fit a particularly sized user's finger. A comfortable fit may be further effected by adjusting length d2 to control the location of straight member 104, as indicated by arrow E1. The length d3 of straight portion 104 is less than d1. Straight portion 104 is preferably formed starting at a point 104*a* measured by angle A, delineated by points 105-C-104*a*, and by example 20 degrees. Also, straight portion 104 is seen to be formed below a semi-circular portion of the finger band portion B and parallel to line 105—105. Although not shown, it should be readily apparent that the accessory 100 may be formed from a flat, thin, narrow, one-piece construction metallic structure having one end formed as pry end 101 and the other end as finger band end 104*b*, shown in FIG. 5. FIG. 4 shows accessory 100 and finger band B having a width w which, by example, is sized to fit the upper joint of the thumb as shown in FIG. 3, without impeding joint movement. FIG. 6 is a bottom view of accessory 100 illustrating the pry means 102, straight portion 104 and finger band end 104*b*. FIG. 5 shows pry means 102 with pry end 101 formed as a rounded extension of the finger band portion B and protrudes in a hook-like manner away from finger band end 104*b* a distance of at least 6 millimeter. The criticality in the distance of protrusion of pry means 102 being that an adequate amount of flat mass be provided to extend beneath pull-tab 202 to effect a prying action that results in breaking a seal maintained by seal member 203S, see FIGS. 2 and 2*a*. FIG. 5*a* shows the chamfering on pry end 101 that produces a rounded, fingertip/fingernail-like shape starting at a point 101*a* and terminating at end 101*b*. The thickness d7 is approximately one (1) millimeter while thickness d6 is approximately one-half (½) millimeter. Thickness d6 is less than space d4 provided beneath pull-tab 202 and facilitates ease of snagging the pry end 101*b* beneath the pull-tab 202, see FIG. 2*a*. The material chosen to form accessory 100 should be sufficiently rigid in the w direction to withstand multiple prying actions. Metallic materials, such as copper, aluminum, tin and precious metals, such as silver and gold may be used with satisfactory results. Plastic materials of comparable material strength to the metals may also be utilized to form the accessory.

FIG. 3 shows accessory 100 further provided with a decor item 300 located on upper band portion 103. As shown, item 300 is provided as a decorative horseshoe/-shamrock mark means for indicating correct orientation of pry end 101. In event that a precious metal is used to form the accessory 100, a user may adapt decor item 300 as a jewelry setting (not shown). FIG. 3 also shows accessory 100 being worn such that the pry end 101 is inconspicuously located, giving the appearance of merely a thumb ring being worn.

Referring back to FIGS. 2 and 2*a*, a beverage container 200 is shown provided with sidewall 204 extending to upper rim portion 204R, having a lid 205 upon which a flip-top mechanism 201 is provided. Flip-top mechanism 201 comprises a pull-tab member 202 and a seal member 203S. Pull-tab member 202, in a seal state, is disposed very close to lid 205, see space d4 in FIG. 2*a*, and is maintained away from rim portion 204R to avoid inadvertent opening. By example, FIG. 2 shows a front view of a user, whose left hand is grasping the container 200 while the right hand is in the process of opening the flip-top mechanism 201. Also, by example, the thumb of the right hand is wearing the accessory 100 and is positioned with pry means 102 beneath pull-tab 202. As best seen in FIG. 2*a*, a wrist-rotating motion F1, acting for a distance d5, lifts pull-tab 202 to become a lifted tab 202L and causes seal member 203S to rupture, as shown by rupture arrow F2, and become ruptured seal member 203R, and thus complete the opening task.

Therefore, while the present invention has been shown and described herein in what is believed to be the most practical and preferred embodiment, it is recognized that departures can be made therefrom within the scope of the invention, which scope is therefore not to be limited to the details disclosed herein but is to be accorded the full scope of the claims so as to embrace any and all equivalent apparatus.

I claim:

1. An accessory apparatus for opening containers provided with flip-top opening mechanisms, said apparatus comprising:

a finger band means for carrying said apparatus, said band means comprising an upper rounded band portion, and a straight band portion, said straight band portion being formed below a semi-circular portion of said upper rounded band portion and extending from a first end of said upper band portion; and a pry means extending from a second end of said upper rounded band portion for urging said flip-top opening mechanism.

2. An accessory apparatus for opening containers as described in claim 1, wherein:

said finger band means and said pry means being produced from a flat, thin, narrow, one-piece construction metallic structure.

3. An accessory apparatus for opening containers as described in claim 1, wherein:

said finger band means and said pry means being molded from a plastic substance.

4. An accessory apparatus for opening containers as described in claim 1, wherein:

said finger band means and said pry means being produced from a flat, thin, narrow, one-piece construction precious metal structure; and said finger band means further comprises a jewelry setting.

5. An accessory apparatus for opening containers as described in claim 1, wherein:

said finger band means further comprises an decorative mark means for indicating correct orientation of said pry means.

6. An accessory apparatus for opening containers as described in claim 1, wherein:

said finger band means and said pry means being produced from a flat, thin, narrow, flexible, one-piece construction metallic structure, said straight band portion being adjustable about said upper band portion for adapting said finger band means to fit different circumferential sizes of fingers.

7. An accessory apparatus for opening containers provided with flip-top opening mechanisms, said apparatus comprising:

a finger band means for carrying said apparatus; and a pry means extending from said finger band means for urging said flip-top opening mechanism, said finger band means and said pry means being produced from a flat, thin, narrow, one-piece construction metallic structure having a pry end and finger band end, said finger band means comprising a rounded band portion and a straight band portion for encircling a user's finger, such as a thumb, said straight band portion terminating proximate an opposing inner surface of said rounded band portion, and being formed below a semi-circular portion of said rounded band portion and extending from a first end of said rounded band portion, and said pry means comprising an extension from a second end of said rounded band portion terminating at said pry end, said pry end being chamfered for facilitating snagging a pull-tab member of said flip-top opening mechanism.

8. An accessory for opening containers as described in claim 7, wherein:

said metallic structure being a precious metal structure; and said finger band means further comprises a jewelry setting.

9. An accessory apparatus for opening containers as described in claim 7, wherein:

said finger band means further comprises an decorative mark means for indicating correct orientation of said pry means.

10. An accessory apparatus for opening containers as described in claim 7, wherein:

said straight band portion being adjustable about said rounded band portion for adapting said finger band means to fit different circumferential sizes of fingers.

11. A method for opening containers provided with flip-top opening mechanisms, said method comprising the steps of:

(a) providing a thumb fitting accessory, said accessory comprising:

a band means for carrying said apparatus on a user's thumb, said band means comprising an upper rounded band portion, and a straight band portion, said straight band portion being formed below a semi-circular portion of said upper rounded band portion and extending from a first end of said upper band portion, and a pry means extending from a second end of said upper rounded band portion for urging said flip-top opening mechanism;

(b) providing a container having a flip-top opening mechanism, said mechanism including a pull-tab member and a seal member;

(c) comfortably wearing said provided accessory on a thumb by adjusting said straight band portion about said upper rounded portion;

(d) positioning a pry end of said pry means beneath said pull-tab member; and (e) urging said pull-tab member by thumb lifting action to effect rupturing a seal made by said seal member to open said container.

12. A method for opening containers as described in claim 11, wherein prior to said step of wearing said accessory, said method comprises the step of:

orienting said accessory such that said pry means has a pry end oriented inward towards a user's palm.

* * * * *